US006258212B1

(12) United States Patent
Egelhof

(10) Patent No.: US 6,258,212 B1
(45) Date of Patent: Jul. 10, 2001

(54) DEVICE AND PROCESS FOR APPLICATION OF A MEDIUM ONTO A MATERIAL WEB

(75) Inventor: Dieter Egelhof, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/301,717

(22) Filed: Apr. 29, 1999

(30) Foreign Application Priority Data

May 8, 1998 (DE) ..... 198 20 585

(51) Int. Cl.[7] ..... D21F 11/00

(52) U.S. Cl. ..... 162/186; 162/266; 162/202; 162/308; 162/265; 162/182; 162/102; 162/203; 162/208; 162/322; 162/300

(58) Field of Search ..... 162/186, 266, 162/202, 308, 265, 182, 102, 203, 208, 322, 300

(56) References Cited

U.S. PATENT DOCUMENTS 1,587,027 6/1926 O'Brien .
3,560,334 * 2/1971 Arledter ..... 162/168
3,577,290 5/1971 Baskerville et al. .
4,737,242 * 4/1988 Jenkins ..... 162/322
4,808,266 * 2/1989 Faurie ..... 162/102

FOREIGN PATENT DOCUMENTS 1942348 3/1971 (DE) .
6932836 12/1971 (DE) .

* cited by examiner

*Primary Examiner*—Stanley S. Silverman
*Assistant Examiner*—Mark Halpern
(74) *Attorney, Agent, or Firm*—Greenblum & Bernstein, P.L.C.

(57) ABSTRACT

Device and process for applying a liquid or paste-like medium onto a traveling material web of paper or cardboard. In the application of the application medium, the material web is transferred from a first twin wire zone to a second twin wire zone. The second twin wire zone may be more finely meshed than the first twin wire zone to reduce marking and impressions in the web. The application medium may be applied and drained from one side or from both sides of the first twin wire zone or second twin wire zone. Application devices and draining (suction) devices for the application medium may oppose each other across a twin wire zone, or be arranged in alternating fashion along a twin wire zone.

22 Claims, 2 Drawing Sheets

DEVICE AND PROCESS FOR APPLICATION OF A MEDIUM ONTO A MATERIAL WEB

CROSS-REFERENCE TO RELATED APPLICATIONS

The present application claims priority under 35 U.S.C. § 119 of German Patent Application No. 198 20 585.6, filed on May 8, 1998, the disclosure of which is expressly incorporated by reference herein in its entirety.

BACKGROUND OF THE INVENTION

1. Field of the Invention

The invention relates to a process and device for applying a liquid or paste-like medium onto a traveling material web made of paper or cardboard.

2. Description of Background Information

The inventors regard German Patent DE 194 23 48 as the most closely related prior art. As shown in FIG. 1 of this document, a fibrous suspension is deposited on a base (e.g., lower) endless wire or screen 3 by means of a headbox 1. A set of drainage elements 2 are disposed on the side of the wire or screen 3 opposite the side on which the fibrous suspension is deposited (e.g., on the inner side of the wire). A fibrous web 8 is formed along the lower wire or screen 3.

After the initial drainage zone, a second endless wire or screen 10 is arranged on the opposing (e.g., upper) side of the fibrous web 8. The base endless wire 3 has not been covered by an upper wire or screen up to this point. A second set of drainage elements 11 (suction devices) is disposed on the inner side of this second wire or screen 10, e.g., the side that does not touch the fibrous web 8. Consequently, drainage of the fibrous web 8 occurs in the opposing (e.g., upper) direction in this second region.

Opposing the second set of drainage elements 11, a set of application devices 7 (applicators) are associated with the wire surface on the underside of the base wire or screen 3. These application devices 7 introduce an application medium (additive) through the lower or base wire 3 into the fibrous web (borne on the upper side of the lower or base web 3). The drainage elements 11 (suction devices) on the inner side of the second wire 10 encourage the penetration of the application medium into the fibrous web 8. In the twin wire region (e.g., where the fibrous web is between the upper and lower endless wires or screens), essentially only drainage elements 11 are disposed on the inner side of one wire or screen 10, 3, and only application devices 7 are disposed on the inner side the other wire or screen. That is, with this arrangement, the application medium is applied to only one side of the fibrous web 8.

This structure and process are disadvantageous and use a relatively coarse wire structure. Due to the application of the application medium, the papers produced have coarse wire marks. Consequently, the resulting paper web has raised areas and recesses in the web that reduce the quality of the paper.

SUMMARY OF THE INVENTION

Other exemplary embodiments and advantages of the present invention may be ascertained by reviewing the present disclosure and the accompanying drawing.

An object of the invention, therefore, is to find a process and device that produce an improved surface quality in the resulting paper web.

According to a first aspect of the invention, a process for applying an application medium onto a material web includes forming the material web in a first twin wire zone between a first opposing pair of driven endless wires, transferring the material web to a second twin wire zone between a second opposing pair of driven endless wires, and applying the application medium onto the material web through one or both of the second opposing pair of driven endless wires.

In this manner, the application process is embodied so that the first fibrous web is produced in a first twin wire zone, which is optimally designed for drainage. Then, the fibrous web is transferred to a second twin wire zone, which is optimally designed, in terms of mechanical properties, for the application of the application medium in the wire region.

Preferably, the application of the application medium is through a different, finer mesh structure (in the second opposing pair of driven endless wires) than the first opposing pair of driven endless wires.

This improvement particularly addresses the problem that wire marks are produced because the strands of the wire cover a part of the fibrous web and therefore, the application medium does not travel well between the fibrous web and the strands at the covered regions. On the other hand, during the application of the application medium, a build-up occurs in the region of a mesh. When the wire is removed from the fibrous web surface that is coated with the application medium, small, undesirable raised areas are produced in the region of the wire meshes. The larger the wire meshes, the larger the raised areas become. These raised areas lead to problems in the further treatment of the fibrous web. It can also be advantageous if the wire mesh or web (disposed opposite the application device) is mechanically designed for an optimal supporting role so that a very smooth application is produced over the entire width of the wire.

More particularly, wire that is used both for drainage and for supporting the fibrous web during the application of the application medium actually can be optimally designed for only one of the two objects. If the wire is optimally designed for drainage, then it has a relatively large mesh width so that an effective and rapid drainage is produced in the beginning region of the wire section. Accordingly, in the invention, one or both of the second opposing pair of endless wires (through which the application medium is applied to the material web) can be embodied as a porous belt or as a more finely structured mesh than the first opposing pair of endless wires, which are used for the drainage of the wire web.

Optionally, the application medium may be applied to only one side of the material web through one of the second opposing pair of driven endless wires. Alternatively, the application medium may be applied to both sides of the material web through both of the second opposing pair of driven endless wires.

In this manner, in the second twin wire zone, it is possible to provide the fibrous web with an application medium from both sides. This has the further advantage that the respective opposite wires support the application devices. However, as noted, the application medium may be optionally applied from only one side. In this instance, only the wire disposed on the application side needs to be finely structured.

When the application medium is applied onto a first side of the material web through one or both of the second opposing pair of driven endless wires, the second side of the material web, opposite the first side of the material web, may be drained via suction. Further, after the draining, an additional application of the application medium to the second side through the remaining one of the second opposing pair of driven endless wires may be performed, along with an additional draining via suction on the first side of the material web. Alternatively, an additional draining via suction on the second side of the material web (without additional application of the medium) may be performed.

In this manner, especially when the wires are finely meshed, the draining leads to an increase in the dry matter content of the fibrous web without leaving behind wire marks of any consequence.

According to another aspect of the present invention, a process for forming a material web and applying an application medium onto the material web includes introducing a fibrous suspension into at least one twin wire zone between at least one opposing pair of driven endless wires, draining the material web in the twin wire zone to form the material web from the fibrous suspension, applying the application medium onto the material web on a first side of the material web, draining the application medium from the material web from a second side of the material web opposite the first side, applying the application medium onto the material web on the second side of the material web, and draining the application medium from the material web from the first side of the material web.

In this manner, it is possible to provide the material web with an application medium from both sides, and the disposition of the drainage elements on opposite sides prevents asymmetry in the material web surface.

Optionally, all of the applying and draining of the application medium are performed in order in alternate positions along the twin wire zone. Alternating the draining in the twin wire zone encourages symmetrical sheet formation in the fibrous web.

Alternatively, the application of the application medium on the first side of the material web and the draining of the application medium from the second side are performed from positions directly opposite one another across the twin wire zone, while the application of the application medium onto the material web on the second side and the draining of the application medium from the material web from the first side are also performed from positions directly opposite one another across the twin wire zone. The disposition of the draining and application directly opposite each other in the twin wire zone produces a more precise guidance of the wire, and consequently improves the application and drainage process.

In still another aspect of the present invention, a paper machine includes a first twin wire zone, having a first opposing pair of driven endless wires, that circulates and bears a material web. A second twin wire zone, having a second opposing pair of driven endless wires, circulates in the same direction as the first twin wire zone and accepts the material web from the first twin wire zone. The second twin wire zone is provided downstream in the direction of circulation from the first twin wire zone. At least one application device is positioned along the second twin wire zone for applying an application medium onto one or both sides of the material web through one or both of the second opposing pair of driven endless wires.

Again, in this manner, the paper machine is embodied so that the first fibrous web is produced in a first twin wire zone, which is optimally designed for drainage. Then, the fibrous web is transferred to a second twin wire zone, which is optimally designed, in terms of its mechanical properties, for the application of the application medium in the wire region.

Preferably, one (or both) of the second opposing pair of driven endless wires, through which the application medium is applied, has a different, finer mesh structure than the first opposing pair of driven endless wires. Again, for substantially the reasons given above with respect to the inventive process, one or both of the second opposing pair of endless wires, through which the application medium is applied to the material web, can be embodied as a porous belt or as a more finely structured mesh than the first opposing pair of endless wires, which are used for the drainage of the wire web. In this case, both of the second opposing pair of driven endless wires may have the same structure (e.g., finely meshed).

Preferably, the paper machine further includes one or more drainage devices that drain application medium applied onto the material web, the drainage device(s) being disposed along the second twin wire zone. In this case, the drainage device(s) and application device(s) may be arranged in alternate positions along the second twin wire zone. An alternating disposition of the drainage elements in the second twin wire zone encourages symmetrical sheet formation in the fibrous web. Alternatively, the drainage device(s) and the application device(s) are arranged in positions opposing one another across the second twin wire zone. A disposition of the drainage device and application device opposite or directly opposite each other in the second twin wire zone produces a more precise guidance of the wire, and consequently improves the application and drainage process.

Alternatively, the paper machine includes at least two drainage devices that drain the application medium applied onto the material web, disposed along the second twin wire zone. In this manner, especially when the wires are finely meshed, the additional draining leads to an increase in the dry matter content of the fibrous web without leaving behind wire marks of any consequence.

Optionally, one or both of the second opposing pair of driven endless wires includes a porous belt.

In a modification of this aspect of the present invention, the paper machine includes one or more application device (s) along the first twin wire zone for applying an application medium onto one or more side(s) of the material web (through the first opposing pair of driven endless wires), and corresponding drainage device(s) that drain application medium applied onto the material web. In this case, the drainage device(s) are also disposed along the first twin wire zone. In this manner, the alternating or opposing structure of the paired application devices and drainage devices, that encourages smoother formation of the fibrous web, may be additionally used in the first twin wire zone.

According to yet another aspect of the present invention, a paper machine includes a twin wire zone, having a first driven endless wire and a second driven endless wire opposing the first driven endless wire, the twin wire zone circulating and bearing a material web. A first application device along the twin wire zone applies an application medium onto a first side of the material web through the first driven endless wire, and a first drainage device drains the application medium applied onto the material web, the first drainage device draining the application medium through the second driven endless wire from a second side of the material web opposite the first side. A second application device along the twin wire zone applies the application medium onto the second side of the material web, that is, through the second driven endless wire. A second drainage device along the twin wire zone drains the application medium applied onto the material web, the second drainage device draining the application medium through the first driven endless wire, that is, from the first side of the material web.

In this manner, it is possible to provide the material web with an application medium from both sides. The respective opposite wires support the application devices, and disposition of the drainage elements on opposite sides prevents asymmetry in the material web surface.

Optionally, the first application device, the first drainage device, the second application device, and the second drainage device are arranged in order in alternate positions along the twin wire zone. An alternating disposition of the drainage elements in the second twin wire zone encourages symmetrical sheet formation in the fibrous web.

Alternatively, the first application device and the first drainage device are arranged in positions directly opposing one another across the twin wire zone and the second application device, and the second drainage device are arranged in positions directly opposing one another across the twin wire zone. The disposition of the drainage devices and application devices directly opposite each other in the second twin wire zone produces a more precise guidance of the wire, and consequently improves the application and drainage process.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE EMBODIMENTS

The particulars shown herein are by way of example and for purposes of illustrative discussion of the embodiments of the present invention only, and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
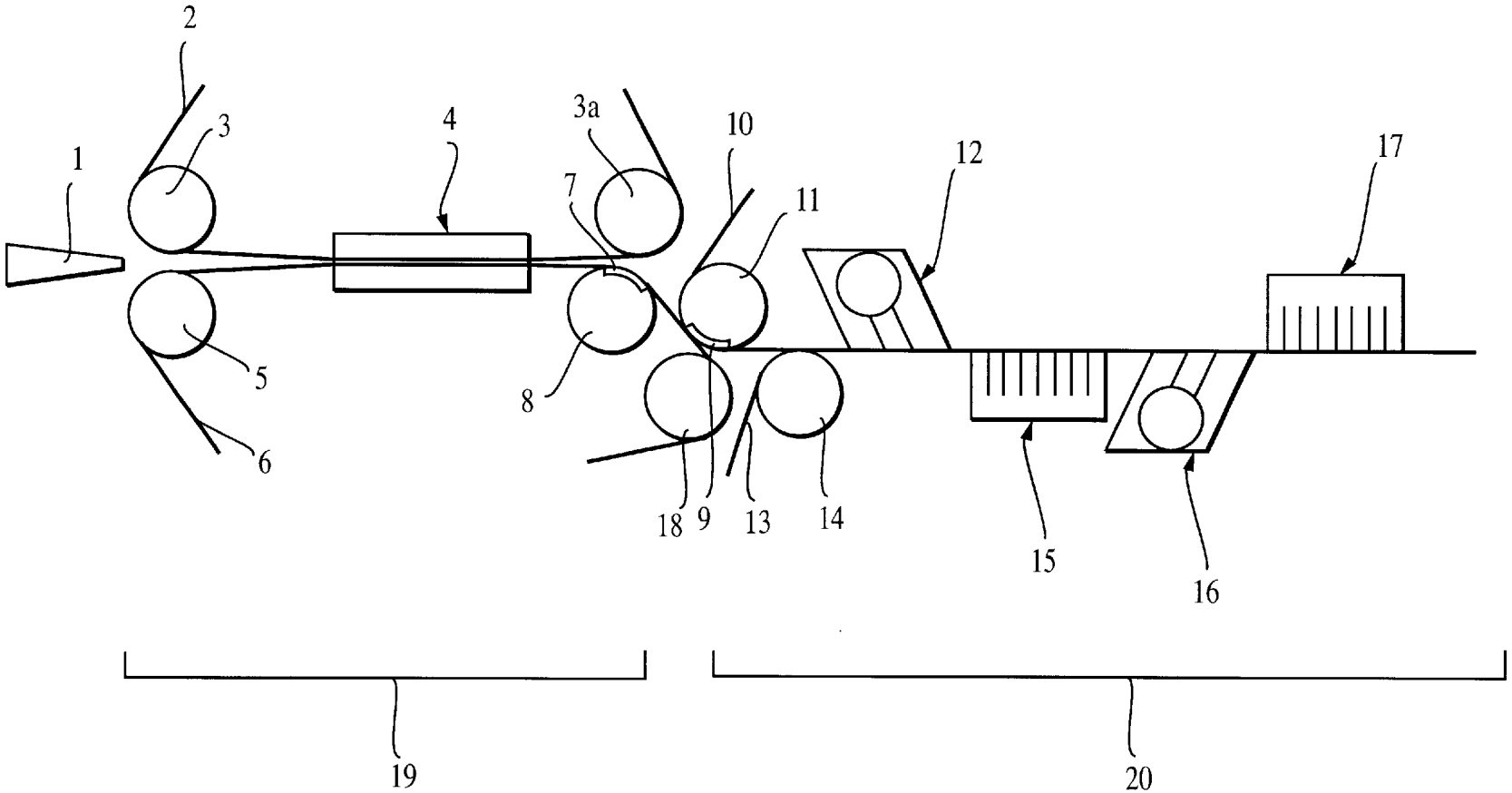
FIG. 1 shows a wire section of a paper or cardboard machine according to a first embodiment of the invention.

FIG. 1 shows a wire section of a paper or cardboard machine according to the invention. Other features, embodiments, and advantages of the invention ensue from the following description of an exemplary embodiment in conjunction with the sole drawing, FIG. 1. FIG. 1 depicts four endless wires 2, 6, 10, and 13. It should be noted, and the inventors emphasize, that as described herein, "wire" means wires, wire mesh, wire screens, and/or porously structured belts capable of bearing a fibrous suspension or web that is formed into paper or cardboard.

In general, wire marks are produced in a fibrous web because the strands or mesh of the wire cover a portion of the fibrous web. Therefore, the application medium does not travel well between the fibrous web and the strands at the covered regions. On the other hand, during the application of the application medium, a build-up occurs in the region of a mesh. When the wire is removed from a fibrous web surface that is coated with an application medium, small, undesirable raised areas are produced in the region of the wire meshes. The larger the wire meshes, the larger the raised areas become. These raised areas lead to problems in the further treatment of the fibrous web. It can also be advantageous if the wire web, which is disposed opposite the application device, is mechanically designed for an optimal supporting action so that as smooth as possible an application is produced over the entire width of the wire.

The application device and process are embodied so that a fibrous web P is first produced in a first twin wire zone 19, which is optimally designed for drainage. Then, the fibrous web P is transferred to a second twin wire zone 20, which is optimally designed, in terms of mechanical properties, for the application of an application medium in the wire region.

As shown in FIG. 1, an (endless) first base wire 6 is arranged at the outlet of a headbox nozzle 1 (to the left of FIG. 1), and circulates downstream between first and second guide rolls 5 and 8, turning down at an angle toward a third guide roll 18. An (endless) first upper wire 2 opposes the first base wire 6, and also circulates downstream, between first and second wire guide rolls 3, 3*a*. The second guide roll 8 of the base wire incorporates a suction zone 7 for separating a fibrous web from the first upper wire or web 2. The distance between the wire guide rolls 3 and 5 at the headbox nozzle 1 determines the opening width of a gap into which a fibrous suspension may be sprayed from the headbox nozzle 1.

A first twin wire zone 19 is produced, in which the first upper wire 2 and the first base wire 6 oppose one another. Downstream of the headbox nozzle 1 in the first twin wire zone 19, a first twin wire sheet forming zone 4 drains a web suspension proceeding along the first twin wire zone 19. The draining forms the fibrous web P.

In terms of mechanical properties, a wire that might be used for drainage or for supporting the fibrous web during the application of an application medium actually can be optimally designed for only one of the two objects. Accordingly, the wires 2, 6 of the first twin wire zone 19 are optimally designed for drainage, and have a relatively large mesh width so that an effective and rapid drainage is produced in the beginning region (first twin wire zone 19) of the wire section.

A first finely meshed wire 13 is arranged downstream of the first twin wire zone 19 (the "first finely meshed wire" may also be designated a "second upper wire"). The first finely meshed wire 13 is an endless wire wound around at least a removal suction roll 11, and circulates downstream, in the same direction as the wires of the first twin wire zone 19. The removal suction roll 11 opposes the first base wire 6 between the wire guide rolls 8 and 18, and is arranged to touch the first finely meshed wire 13 to the fibrous web P borne by the first base wire 6 (after separation from the first upper wire 2 at the suction zone 7 of the guide roll 8). The removal suction roll 11 incorporates a second suction zone 9 for deflecting the fibrous web P onto the first finely meshed wire 13.

A second finely meshed wire 13 opposes the first finely meshed wire 10 downstream of the removal suction roller 11 (the "second finely meshed wire" may also be designated a "second base wire"). Optionally, the two wires 10, 13 of the second twin wire zone 20 have the same structure. The second finely meshed wire 13 is an endless wire wound about at least a wire guide roller 14, and the wire guide roller 14 contacts the second finely meshed wire 13 to the fibrous web P borne by the first finely meshed wire 10 from underneath. In the drawing, both of the first and second finely meshed wires 10, 13 circulate downstream from the rollers 11, 14.

A second twin wire zone 20 is produced, in which the first finely meshed wire 10 and the second finely meshed wire 13 oppose one another. The second twin wire zone 20 has more finely meshed wires 10, 13 than the first twin wire zone 19 that is used for formation of the fibrous web P. Optionally, the wires 10 and/or 13 of the second twin wire zone 20, through which the application medium is applied to the material web (e.g., fibrous web P), can be embodied as a porous belt or as a more finely meshed or structured wire than the wires 2, 6 of the first wire zone 19, which are primarily used for drainage.

In the second twin wire zone 20, a first application device 12 (for applying an application medium onto the fibrous web P) faces the second finely meshed wire 13 through the first finely meshed wire 10 (from the upper side). A first drainage element 15 (e.g., a suction device for draining the fibrous web) faces the first finely meshed wire 10 through the second finely meshed wire 13 (from the lower side).

The first application device 12 (and other application devices described herein) can be of any known or equivalent form. One example of an appropriate application device is a stroking subassembly in the form of a slot nozzle or doctor device. Furthermore, the first application device 12 can be a spray application system. The application medium is preferably in the form of, but is not limited to, a liquid or paste-like medium.

Further downstream along the second twin wire zone 20, a second application device 16 (for applying an application medium onto the fibrous web P) faces the first finely meshed wire 10 through the second finely meshed wire 13 (from the lower side). A second drainage element 17 (e.g., a suction device for draining the fibrous web) faces the second finely meshed wire 13 through the first finely meshed wire 10 (from the upper side). The disposition of the drainage elements 15, 17 on alternating sides prevents asymmetry in the fibrous web P surface.

In summary, the paper machine depicted in FIG. 1 includes a "wire section" includes the first twin wire zone 19 and the second twin wire zone 20. The first twin wire zone 19 has wires (2 and 6) that travel in the form of a sandwich, while the second twin wire zone 20 is provided after the first twin wire zone 19, and has at least one application device (e.g., application devices 12 and/or 16) on at least one side of the web. The application device (e.g., 12 and/or 16) applies a liquid or paste-like application medium onto a traveling material web (e.g., fibrous web P) made of paper or cardboard.

In the first embodiment, at least one of the wires (e.g., 10 and/or 13) of the second twin wire zone 20 has a different, finer structure (e.g., more finely meshed) than at least one of the wires (e.g., 2 and/or 6) of the first twin wire zone 19. At least one drainage device (e.g., 15 and/or 17) is disposed in the second twin wire zone 20.

Optionally, as shown in FIG. 1, at least one drainage element (e.g., 15 and/or 17) and at least one application device (e.g., 12 and/or 16) alternate in the downstream direction in the second twin wire zone (20). In the second twin wire zone 20, it is possible to provide the fibrous web P with an application medium from both sides, as shown in FIG. 1. This has the further advantage that the respective opposite wire supports the application device 12, 16.

Figure 2:
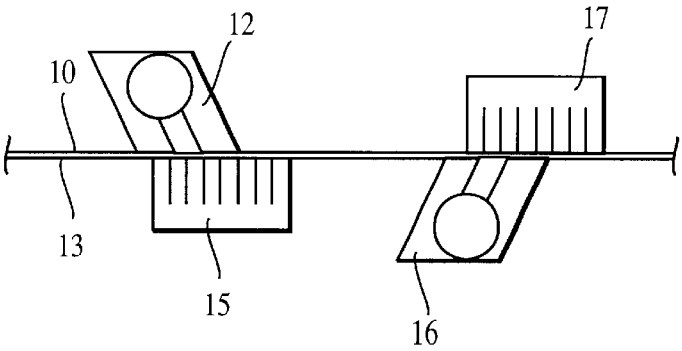
FIG. 2 shows a partial wire section showing a second embodiment of the invention and an arrangement of application devices and draining devices therein.

Alternatively, as shown in the second embodiment depicted in FIG. 2, at least one drainage element (e.g., 15 and/or 17) and at least one application device (e.g., 12 and/or 16) are disposed opposing one another in the second twin wire zone 20, or directly opposing one another. The disposition of the drainage element(s) and application device(s) directly opposite each other in the second twin wire zone 20 produces a more precise guidance of the wire and consequently improves the application and drainage process.

As noted at the beginning of this description, in lieu of the wires used in the second twin wire zone 20, porously structured belts or other web-bearing transport means may be used.

Figure 3:
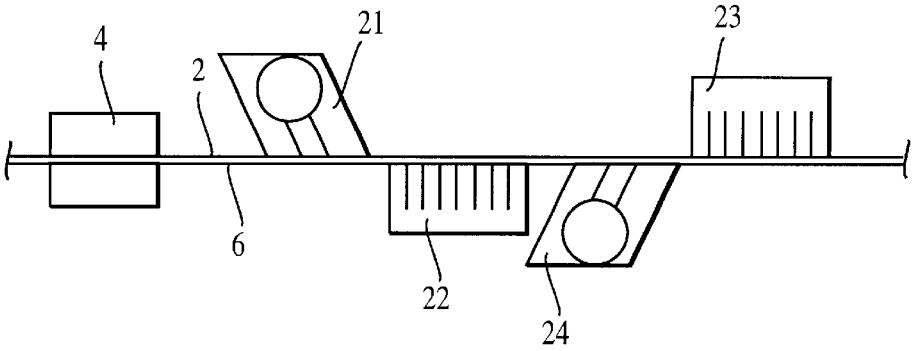
FIG. 3 shows a partial wire section showing a third embodiment of the invention and an arrangement of application devices and draining devices therein.

FIG. 3 shows a third embodiment, in which pre-impregnation of the web and the finer application in the second twin wire zone takes place in the first twin wire zone using application elements 21, 23, and drainage elements 22, 24, in essentially the same manner as described above. In this case, the first twin wire zone 19 may include wires 2, 6, having a fine mesh. That is, optionally, as shown in the third embodiment depicted in FIG. 3, one or more application devices (e.g., 21, 23) and drainage elements 22, 24 may be alternatively or additionally disposed in the first twin wire zone 19.

Figure 4:
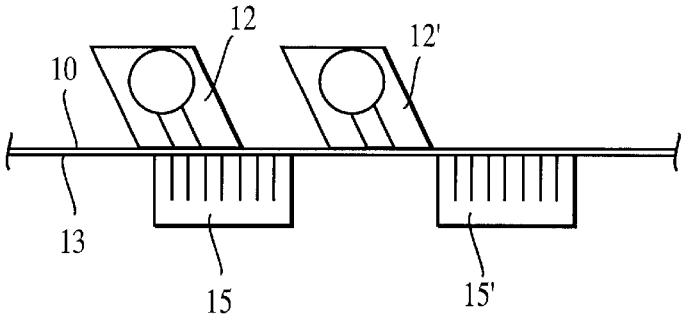
FIG. 4 shows a partial wire section showing a fourth embodiment of the invention and an arrangement of application devices and draining devices therein.

FIG. 4 shows a fourth embodiment, in which the application medium is applied from only one side. In this instance, only the wire disposed on this side (e.g., the upper wire 10 in FIG. 4) is advantageously finely meshed or structured. Although two sets of paired application elements and drainage elements are shown in FIG. 4 (12, 15; 12', 15'), one set may be used instead of two sets.

Figure 5:
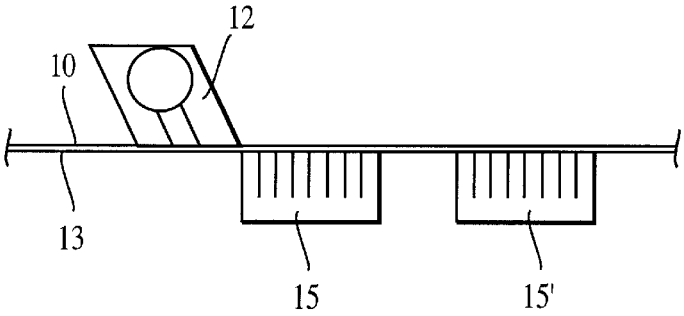
FIG. 5 shows a partial wire section showing a fifth embodiment of the invention and an arrangement of application devices and draining devices therein.

A fifth embodiment according to the invention is the disposition of one or more additional drainage elements 15' in the second twin wire zone 20, as shown in FIG. 5. Due to the fine meshed nature of the wires 20, the drainage elements 15, 15' lead to an increase in the dry matter content of the fibrous web P, without leaving behind wire marks of any consequence. An alternating disposition of drainage elements in the second twin wire zone (e.g., as shown in FIGS. 1–3) also encourages the symmetrical sheet formation of the fibrous web.

In the operation of the process, as shown in FIG. 1, a fibrous suspension is sprayed from the headbox nozzle 1 into the gap between the wires 2, 6. In the first twin wire sheet-forming zone 4 of the first twin wire zone 19, the suspension is drained until a fibrous web P forms. The first upper wire 2 is removed from the fibrous web P in the winding region of the wire 6 on the wire guide roll 8. That is, the fibrous web P follows the course of the wire 6 through the suction zone 7 disposed in the wire guide roll 8.

In the region between the wire guide rolls 8, 18, the first finely meshed wire 10 touches the fibrous web P. The fibrous web P is deflected onto the first finely meshed wire 10 by means of the removal suction roll 11 and its suction zone 9. The second, finely meshed wire 13—coming from underneath—is deflected by the wire guide roll 14 and is placed against the fibrous web P from beneath. The fibrous web P enters the second twin wire zone 20.

The first application device 12 applies an application medium onto the fibrous web P (from above) through the first finely meshed wire 10. The first drainage element 15 produces a downward drainage (e.g., by suction) and removes additional wire water and/or water of the application medium from the fibrous web P. The second application device 16 likewise applies an application medium onto the other (lower) side of the fibrous web P. The second drainage element 17, which is disposed on top, produces an upward drainage (e.g., by suction).

To summarize, FIG. 1 shows a process for applying a liquid or paste-like application medium onto a traveling material web (e.g., fibrous web P) made of paper or cardboard. In a wire section in the first twin wire zone 19, the material web (e.g., fibrous web P) is formed between two wires (2, 6) that travel in the form of a sandwich. It should be noted that either of the first twin wire zone 19 or second twin wire zone 20 may include (although not shown in the drawings) a region where the fibrous web P travels directly between a wire and a forming roll surface. In the process, the material web (e.g., fibrous web P) is transferred to another (second) twin wire zone 20 with two other wires (e.g., 10, 13) that travel in the form of a sandwich. The application medium is applied onto the material web (e.g., fibrous web P) through at least one of the wires (e.g., 10 and/or 13) of the second twin wire zone 20.

Optionally, as discussed above, the application medium is applied through at least a wire or wires having a different, finer (e.g., finely meshed) structure than the wires (e.g., 2 and/or 6) of the first twin wire zone 19. Optionally, as depicted in FIGS. 4 and 5, the application medium is only applied to one side of the material web (e.g., fibrous web P). Preferably, as depicted in FIGS. 1–3,the application medium is applied to both sides of the material web (e.g., fibrous web P).

In the process, after the application of the application medium, suction is preferably applied (e.g., with suction devices or suction roll) on the side of the material web opposing the application of the application medium. Optionally, an additional application of the application medium takes place on the same side as the first, with suction again applied on the opposite side.

With the above-described device and process according to the invention, the application of an application medium is optimally performed in the wet section of the paper machine. That is, in the manner of the invention, the application takes place with the aid of particularly suited wires (e.g., more finely meshed), while the initial drainage of the fibrous web can be carried out without any constraints imposed by applying the medium or drainage of the same. The invention leads to a significant reduction of wire mark formation and production of smooth surfaces on the paper web.

While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent and/or insubstantially different structures, methods and uses, such as are within the scope of the appended claims.

What is claimed is:

1. A process for applying an application medium onto a material web, in an apparatus having a first twin wire zone and a second twin wire zone, the process comprising:

forming the material web in the first twin wire zone between a first opposing pair of driven endless wires;

transferring the material web to the second twin wire zone between a second opposing pair of driven endless wires; and applying the application medium onto the material web through at least one of said second opposing pair of driven endless wires.

2. The process according to claim 1, wherein said applying comprises applying the application medium onto the material web through at least one of said second opposing pair of driven endless wires having a different, finer mesh structure than said first opposing pair of driven endless wires.

3. The process according to claim 1, wherein said material web has two sides, and wherein said applying comprises applying the application medium to only one side of the material web through at least one of said second opposing pair of driven endless wires.

4. The process according to claim 1, wherein said material web has two sides, and wherein said applying comprises applying the application medium to both sides of the material web through both of said second opposing pair of driven endless wires.

5. The process according to claim 1, wherein said applying comprises applying the application medium onto a first side of the material web through at least one of said second opposing pair of driven endless wires, and further comprising:

draining via suction on a second side of the material web opposite said first side of the material web.

6. The process according to claim 5, further comprising, after said draining:

applying additional application medium to said second side of the material web through a remaining one of said second opposing pair of driven endless wires; and draining via suction on said first side of the material web.

7. The process according to claim 5, further comprising, after said draining:

again draining via suction on said second side of the material web.

8. A process for forming a material web and applying an application medium onto the material web, in an apparatus having at least one twin wire zone, the process comprising:

introducing a fibrous suspension into the at least one twin wire zone between at least one opposing pair of driven endless wires;

draining the material web in said at least one twin wire zone to form the material web from the fibrous suspension;

applying the application medium onto the material web on a first side of said material web;

draining the application medium from the material web from a second side of said material web opposite said first side;

applying the application medium onto the material web on said second side of the material web; and draining the application medium from the material web from said first side of said material web;

wherein at least one of (1) the applying on the first side and draining from the second side of the material web, and (2) the applying on the second side and draining from the first side of the material web, occurs directly opposite from each other with respect to positioning along the at least one twin wire zone.

9. The process according to claim 8, wherein all of said applying and said draining are performed in order in alternate positions along said at least one twin wire zone.

10. The process according to claim 8, wherein said applying the application medium onto the material web on said first side of said material web and said draining the application medium from the material web from said second side of said material web are performed from positions directly opposite one another across said at least one twin wire zone, and said applying the application medium onto the material web on said second side of said material web and said draining the application medium from the material web from said first side of said material web are performed from positions directly opposite one another across said at least one twin wire zone.

11. A paper machine, comprising:

a first twin wire zone, having a first opposing pair of driven endless wires, that circulates and bears a material web;

a second twin wire zone, having a second opposing pair of driven endless wires, that circulates in the same direction as said first twin wire zone and accepts said material web from said first twin wire zone, said second twin wire zone provided downstream in the direction of circulation from said first twin wire zone; and at least one application device along said second twin wire zone for applying an application medium onto at least one side of the material web through at least one of said second opposing pair of driven endless wires.

12. The paper machine according to claim 11, wherein said at least one of said second opposing pair of driven endless wires, through which the application medium is applied, has a different, finer mesh structure than said first opposing pair of driven endless wires.

13. The paper machine according to claim 12, wherein both of said second opposing pair of driven endless wires have the same mesh structure as one another.

14. The paper machine according to claim 11, further comprising:

at least one drainage device that drains the application medium applied onto said material web, said at least one drainage device being disposed along said second twin wire zone.

15. The paper machine according to claim 14, wherein said at least one drainage device and said at least one application device are arranged in alternate positions along said second twin wire zone.

16. The paper machine according to claim 14, wherein said at least one drainage device and said at least one application device are arranged in positions opposing one another across said second twin wire zone.

17. The paper machine according to claim 11, further comprising:

at least two drainage devices that drain the application medium applied onto said material web, said at least two drainage devices being disposed along said second twin wire zone.

18. The paper machine according to claim 11, wherein each of said second opposing pair of driven endless wires comprises a porous belt.

19. The paper machine according to claim 11, further comprising:

at least one application device along said first twin wire zone for applying an application medium onto at least one side of the material web through at least one of said first opposing pair of driven endless wires; and at least one drainage device that drains application medium applied onto the material web, said at least one drainage device being disposed along said first twin wire zone.

20. A paper machine, comprising:

a twin wire zone, having a first driven endless wire and a second driven endless wire opposing said first driven endless wire, said twin wire zone circulating and bearing a material web;

a first application device along said twin wire zone that applies an application medium onto a first side of the material web through said first driven endless wire;

a first drainage device that drains the application medium applied onto said material web, said first drainage device draining the application medium, through said second driven endless wire, from a second side of said material web opposite said first side;

a second application device along said twin wire zone that applies the application medium onto the second side of the material web through said second driven endless wire; and a second drainage device along said twin wire zone that drains the application medium applied onto the material web, said second drainage device draining the application medium, through said first driven endless wire, from the first side of the material web;

wherein at least one of (1) said first application device and said first drainage device, and (2) said second application device and said second drainage device, are arranged directly opposite each other.

21. The paper machine according to claim 20, wherein said first application device, said first drainage device, said second application device, and said second drainage device are arranged in order in alternate positions along said twin wire zone.

22. The paper machine according to claim 20, wherein said first application device and said first drainage device are arranged in positions directly opposing one another across said twin wire zone, and said second application device and said second drainage device are arranged in positions directly opposing one another across said twin wire zone.

* * * * *